US006029803A

United States Patent [19]

Ovadia et al.

[11] Patent Number: 6,029,803

[45] Date of Patent: Feb. 29, 2000

[54] DISPLAY AND STORAGE BOX WITH INTERLOCKING, FRICTION FITTING HALVES

[75] Inventors: Joseph Ovadia, Little Falls; Tomasz Zawadzki, Clifton, both of N.J.

[73] Assignee: Ovadia Corp., Little Falls, N.J.

[21] Appl. No.: 09/231,036

[22] Filed: Jan. 14, 1999

[51] Int. Cl.[7] ..... B65D 83/00

[52] U.S. Cl. ..... 206/6.1; 220/4.24; 220/4.21; 220/7.96

[58] Field of Search ..... 206/6.1; 220/4.24, 220/4.26, 796, 797, 4.21, 4.25

[56] References Cited

U.S. PATENT DOCUMENTS

| | | | |
|---|---|---|---|
| 3,292,840 | 12/1966 | Schmidt | 220/4.24 |
| 3,565,146 | 2/1971 | Arnolds | 220/4.24 |
| 3,901,406 | 8/1975 | Kivett | 220/4.24 |
| 5,060,851 | 10/1991 | Lorenz | 220/4.24 |
| 5,265,749 | 11/1993 | Zutler | 220/4.24 |
| 5,332,114 | 7/1994 | Sano et al. | 220/4.24 |
| 5,388,714 | 2/1995 | Zutler | 220/4.24 |

*Primary Examiner*—Paul T. Sewell
*Assistant Examiner*—J. Mohandesi
*Attorney, Agent, or Firm*—Richard M. Goldberg

[57] ABSTRACT

A storage box includes an upper half having a top wall and an upper side wall extending down therefrom, with a lower facing edge formed by inner and outer adjacent lower facing wall portions, each including alternating sinusoidal shaped recessed and projecting portions, with the recessed portions of one being in alignment with the projecting portions of the other; and a lower half having a bottom wall and a lower side wall extending up therefrom, with an upper facing edge formed by inner and outer adjacent upper facing wall portions, each including alternating sinusoidal shaped recessed and projecting portions, with the recessed portions of one being in alignment with the projecting portions of the other, and when assembled together, the recessed portions of the inner upper facing wall portion receive the projecting portions of the inner lower facing wall portion such that the projecting portions of the inner lower facing wall portion are in interlocking, friction engagement with the projecting portions of the outer upper facing wall portion, and the recessed portions of the outer upper facing wall portion receive the projecting portions of the outer lower facing wall portion such that the projecting portions of the outer lower facing wall portion are in interlocking, friction engagement with the projecting portions of the inner upper facing wall portion.

9 Claims, 4 Drawing Sheets

DISPLAY AND STORAGE BOX WITH INTERLOCKING, FRICTION FITTING HALVES

BACKGROUND OF THE INVENTION

The present invention relates generally to display and storage devices, and more particularly, is directed to a display and storage box for storing and displaying gift items, such as jewelry, pens, etc.

Boxes are known for storage and display of gift items. Such boxes take many forms. For example, two halves can be hinged together at one edge. However, this requires additional parts and a more complicated assembly, thereby increasing the cost of the box. As another example, a box is known in which one part which holds the gift items is telescopically received in the other part. However, this box requires two parts of different sizes and shapes, thereby also increasing the cost of manufacture. Another box is known in which a bottom part has an inwardly spaced peripheral ledge, and the top or cover part seats thereon in surrounding relation with the ledge and in friction engagement therewith. However, this also requires two parts of different sizes and shapes, thereby also increasing the cost of manufacture.

OBJECTS AND SUMMARY OF THE INVENTION

Accordingly, it is an object of the present invention to provide a display and storage box that overcomes the problems with the aforementioned prior art.

It is another object of the present invention to provide a display and storage box with two interlocking, friction fitting halves of the same size and shape.

It is still another object of the present invention to provide such a display and storage box in which gift items are completely encased in the box and cannot inadvertently escape therefrom.

It is yet another object of the present invention to provide display and storage boxes of the above type made of a relatively rigid plastic material and which can be stacked upon each other.

It is a further object of the present invention to provide a display and storage box that is lightweight and durable, and easy and economical to manufacture and use.

In accordance with an aspect of the present invention, a storage box comprises an upper portion including a top wall, an upper side wall extending down from the top wall and having a lower facing edge, and the lower facing edge of the upper side wall being formed by inner and outer adjacent lower facing wall portions, the inner lower facing wall portion including recessed portions and projecting portions, and the outer lower facing wall portion including recessed portions and projecting portions, with the recessed portions of the inner lower facing wall portion being in alignment with the projecting portions of the outer lower facing wall portion, and the projecting portions of the inner lower facing wall portion being in alignment with the recessed portions of the outer lower facing wall portion; and a lower portion including a bottom wall, a lower side wall extending up from the bottom wall and having an upper facing edge, the upper facing edge of the lower side wall being formed by inner and outer adjacent upper facing wall portions, the inner upper facing wall portion including recessed portions and projecting portions and the outer upper facing wall portion including recessed portions and projecting portions, with the recessed portions of the inner upper facing wall portion being in alignment with the projecting portions of the outer upper facing wall portion, and the projecting portions of the inner upper facing wall portion being in alignment with the recessed portions of the outer upper facing wall portion, and the lower side wall having outer dimensions which are the same as outer dimensions of the upper side wall so as to form a continuation thereof, such that when the upper portion is assembled with the lower portion with the upper and lower side walls in mating relation, the recessed portions of the inner upper facing wall portion receive the projecting portions of the inner lower facing wall portion such that the projecting portions of the inner lower facing wall portion are in interlocking, friction engagement with the projecting portions of the outer upper facing wall portion, and the recessed portions of the outer upper facing wall portion receive the projecting portions of the outer lower facing wall portion such that the projecting portions of the outer lower facing wall portion are in interlocking, friction engagement with the projecting portions of the inner upper facing wall portion.

The recessed portions and projecting portions of each of the inner and outer adjacent upper facing wall portions and the inner and outer adjacent lower facing wall portions, are formed in an alternating manner. Specifically, the alternating recessed portions and projecting portions of each of the inner and outer upper facing wall portions form a substantially sinusoidal shape, and the alternating recessed portions and projecting portions of each of the inner and outer lower facing wall portions form a substantially sinusoidal shape of a complementary configuration to the substantially sinusoidal shaped alternating projecting portions and recessed portions of each of the inner and outer upper facing wall portions.

The upper and lower portions are preferably made from a relatively rigid plastic material that has sufficient flexibility and resilience to permit the interlocking, friction fit.

Preferably, each of the upper and lower portions has a substantially rectangular configuration.

In one embodiment for use as a jewelry box, the lower box further includes at least one jewelry holder therein for holding a jewelry item. The at least one jewelry holder includes an arrangement of ring posts extending upwardly from an inner surface of the bottom wall. Each ring post is formed as a thin walled, resilient structure in a part cylindrical configuration that extends upwardly from the bottom wall at an acute angle, and has opposite free edges. Each ring post has an open, upper end.

The above and other objects, features and advantages of the invention will become readily apparent from the following detailed description thereof which is to be read in connection with the accompanying drawings.

DETAILED DESCRIPTION

Figure 1:
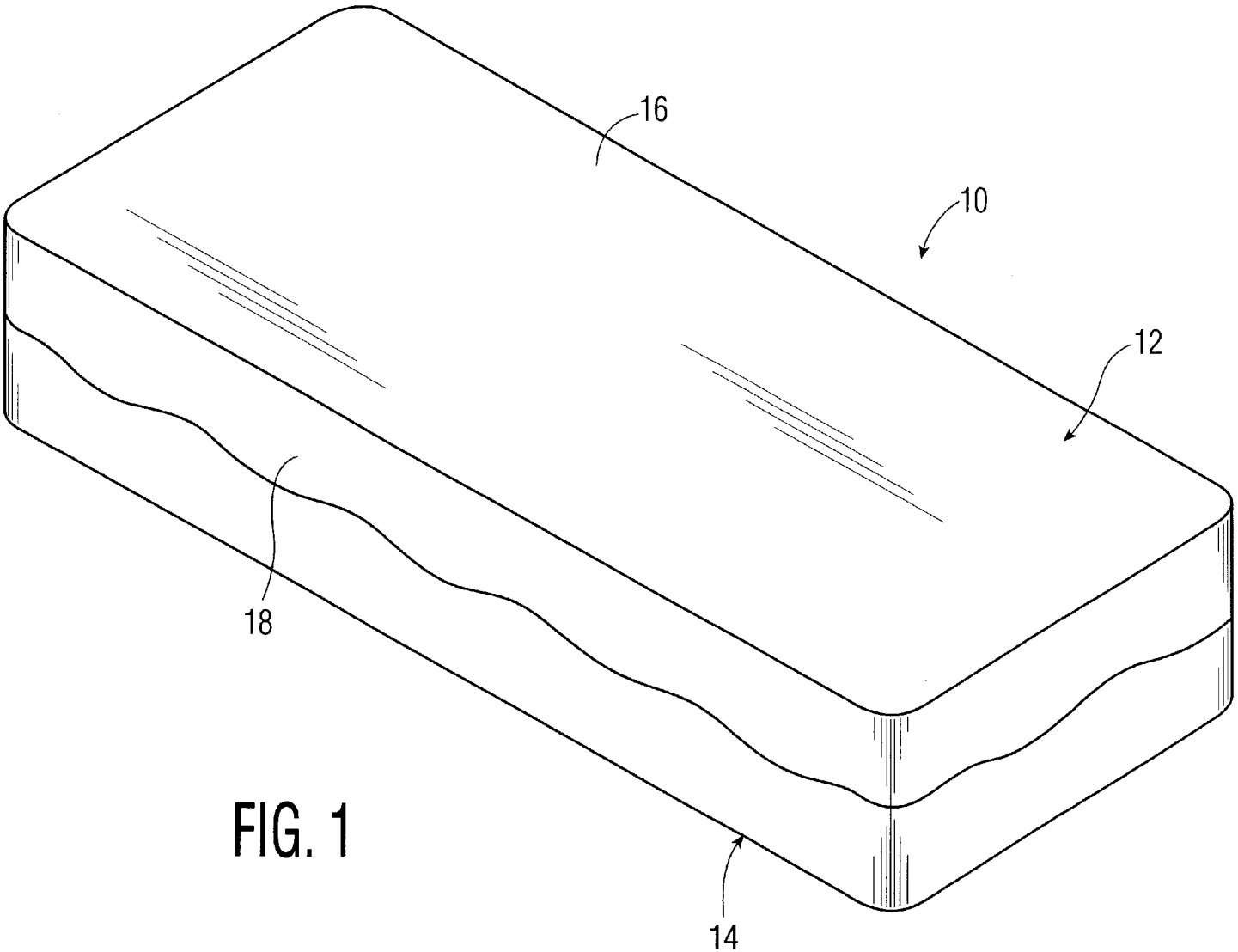
FIG. 1 is a perspective view of a storage box in a closed condition according to the present invention.
Figure 2:
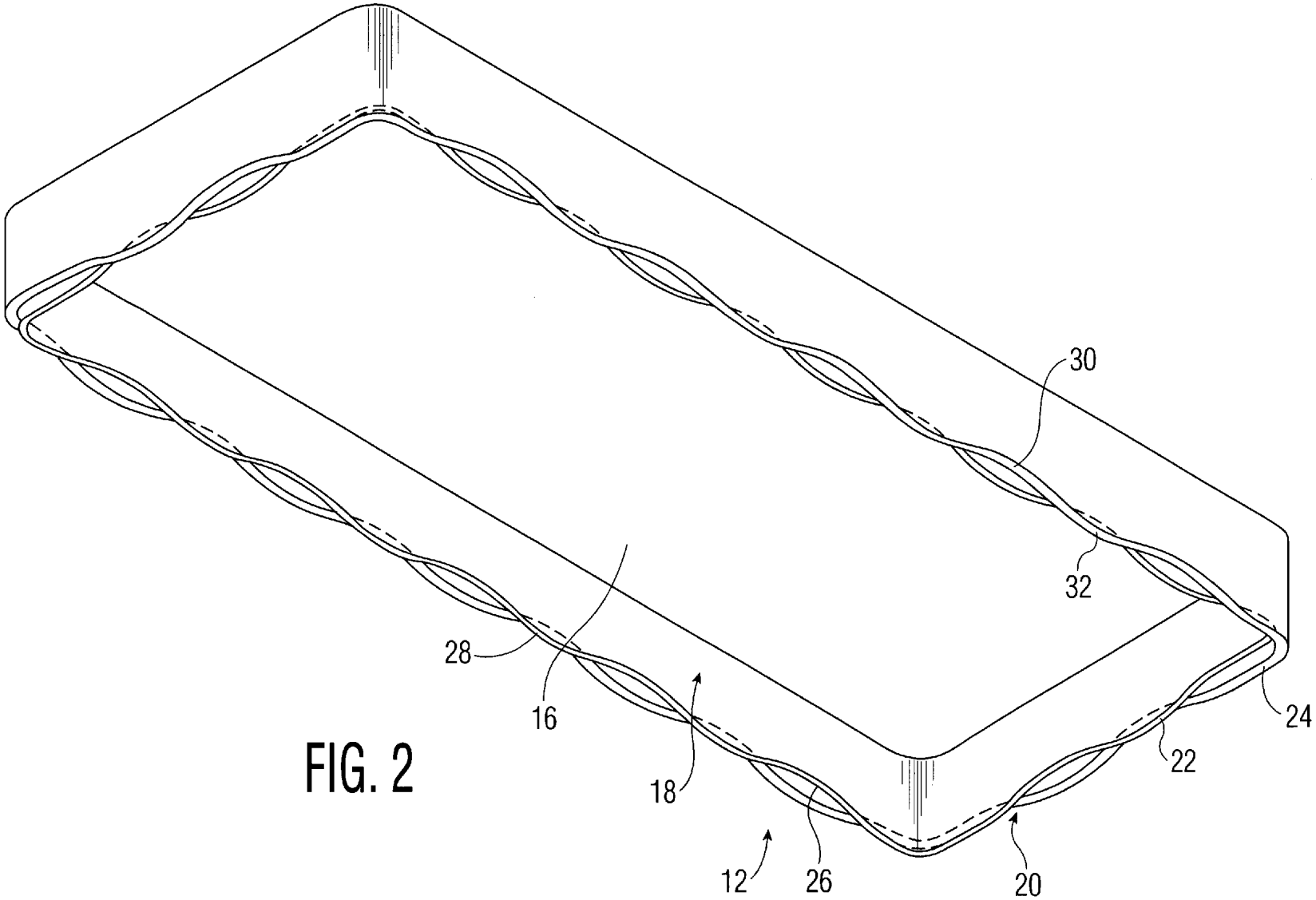
FIG. 2 is a perspective view of the upper half of the storage box of FIG. 1.

Referring to the drawings in detail, a storage box 10 according to the present invention includes an upper half 12 and a lower half 14 of identical size and shape which close upon each other in an interlocking, friction fitting manner.

Upper half 12 includes a top wall 16 of a generally rectangular configuration. However, it will be appreciated that the present invention is not limited thereby, and top wall 16 can have any other suitable configuration, such as circular, oval, triangular, etc. An upper side wall 18 extends down at a right angle from the periphery of top wall 16. However, the present invention is not limited thereby, and upper side wall 18 can extend downwardly from a position spaced inwardly from the periphery of top wall 16, and can extend down at an angle other than a right angle therefrom.

Upper side wall 18 includes a lower facing edge 20 formed by inner and outer adjacent lower facing wall portions 22 and 24. As shown, inner lower facing wall portion 22 includes alternating recessed portions 26 and projecting portions 28, and outer lower facing wall portion 24 includes alternating recessed portions 30 and projecting portions 32. Further, recessed portions 26 of inner lower facing wall portion 22 are in alignment with projecting portions 32 of outer lower facing wall portion 24, and projecting portions 28 of inner lower facing wall portion 22 are in alignment with recessed portions 30 of outer lower facing wall portion 24. Preferably, as shown, alternating recessed portions 26 and projecting portions 28 of inner lower facing wall portion 22 form a substantially sinusoidal shape, and alternating recessed portions 30 and projecting portions 32 of outer lower facing wall portion 24 form a substantially sinusoidal shape, with the crests of the substantially sinusoidal shape forming the projecting portions and the troughs of the substantially sinusoidal shape forming the recessed portions. However, any shape other than sinusoidal can be used, such as triangular, square, etc.

In like manner, lower half 14 includes a bottom wall 36 of a generally rectangular configuration. However, it will be appreciated that the present invention is not limited thereby, and bottom wall 36 can have any other suitable configuration, such as circular, oval, triangular, etc. A lower side wall 38 extends up at a right angle from the periphery of bottom wall 36. However, the present invention is not limited thereby, and lower side wall 38 can extend upwardly from a position spaced inwardly from the periphery of bottom wall 36, and can extend up at an angle other than a right angle therefrom.

Lower side wall 38 includes an upper facing edge 40 formed by inner and outer adjacent upper facing wall portions 42 and 44. As shown, inner upper facing wall portion 42 includes alternating recessed portions 46 and projecting portions 48, and outer upper facing wall portion 44 includes alternating recessed portions 50 and projecting portions 52. Further, recessed portions 46 of inner upper facing wall portion 42 are in alignment with projecting portions 52 of outer upper facing wall portion 44, and projecting portions 48 of inner upper facing wall portion 42 are in alignment with recessed portions 50 of outer upper facing wall portion 44. Preferably, as shown, alternating recessed portions 46 and projecting portions 48 of inner upper facing wall portion 42 form a substantially sinusoidal shape, and alternating recessed portions 50 and projecting portions 52 of outer upper facing wall portion 44 form a substantially sinusoidal shape, with the crests of the substantially sinusoidal shape forming the projecting portions and the troughs of the substantially sinusoidal shape forming the recessed portions. Also, recessed portions and projecting portions 46, 48 and 50, 52 have a complementary configuration to the substantially sinusoidal shaped alternating projection portions and recessed portions 28, 26 and 32, 30, respectively. However, any shape other than sinusoidal can be used, such as triangular, square, etc.

Lower side wall 38 has outer dimensions which are the same as outer dimensions of upper side wall 18 so as to form a smooth continuation thereof. Specifically, when upper portion 12 is assembled with lower portion 14, and with upper and lower side walls 18 and 38 in mating relation, recessed portions 46 of inner upper facing wall portion 42 receive projecting portions 28 of inner lower facing wall portion 22 such that projecting portions 28 are in interlocking, friction engagement with projecting portions 52 of outer upper facing wall portion 44. In like manner, recessed portions 50 of outer upper facing wall portion 44 receive projecting portions 32 of outer lower facing wall portion 24 such that projecting portions 32 are in interlocking, friction engagement with projecting portions 48 of inner upper facing wall portion 42. At the same time, projecting portions 48 and 52 are received in recessed portions 26 and 30.

Preferably, upper half 12 and lower half 14 are made from a relatively rigid plastic material that has sufficient flexibility and resilience to permit the aforementioned interlocking, friction fit.

Thus, with the above arrangement, upper half 12 and lower half 14 can be assembled together to form a closed box having a substantially continuous outer surface, and which halves 12 and 14 are held together by a releasable interlocking, friction fit. It is easy to disassemble and then reassemble halves 12 and 14 numerous times.

Figure 3:
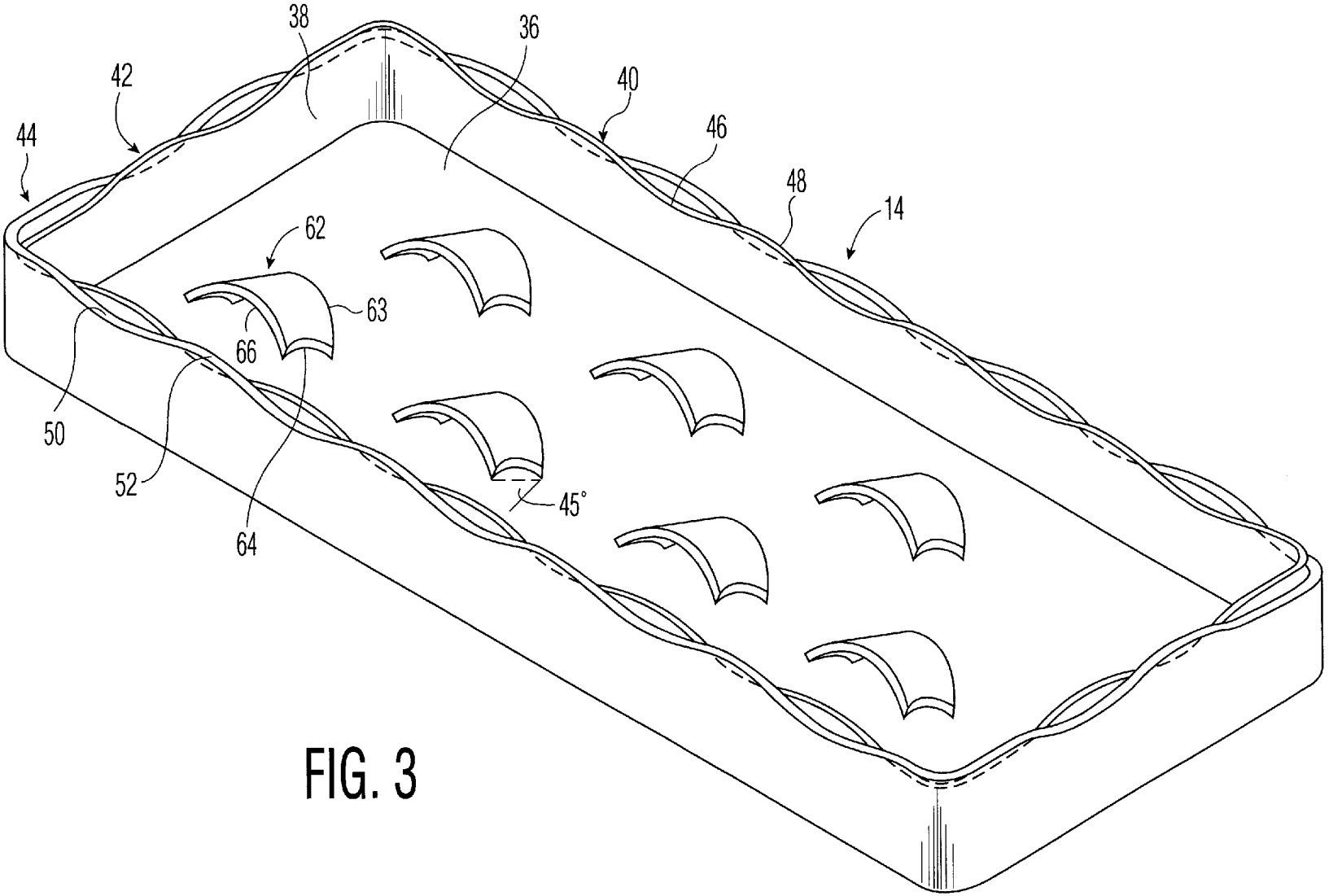
FIG. 3 is a perspective view of a lower half of the storage box of FIG. 1.
Figure 4:
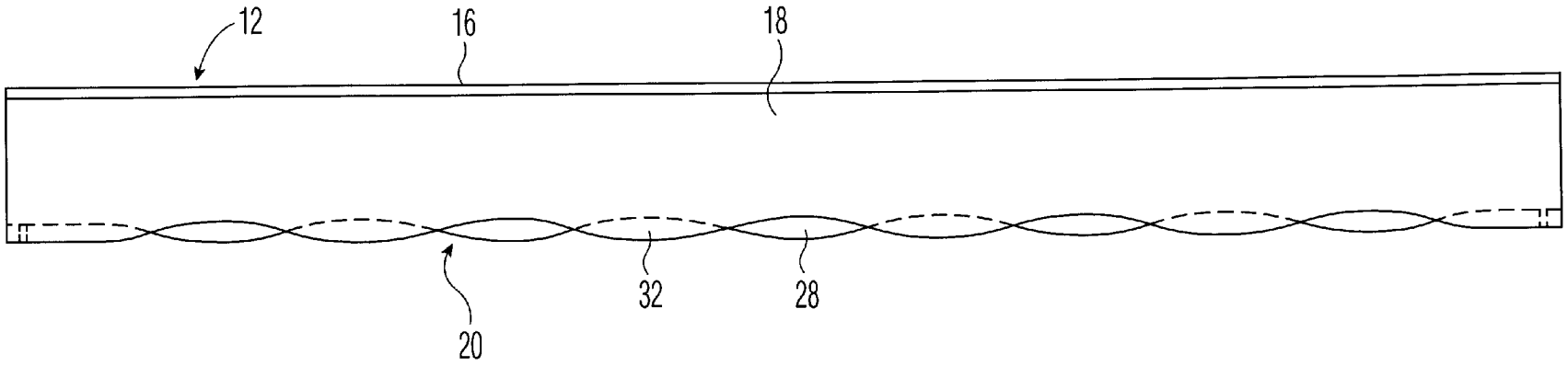
FIG. 4 is a side elevational view of the upper half of FIG. 3.

Storage box 10 has numerous uses, and in this regard, one preferred embodiment is for use as a jewelry box. Specifically, as shown in FIG. 3, lower half 14 includes a plurality of ring posts 62 therein, each for holding a ring thereon.

Each ring post 62 is formed as a thin walled structure, preferably made from a molded, flexible and lightweight plastic or rubber material, which can be covered by a fabric or cloth material. Each ring post 62 can be formed as the ring posts of U.S. Pat. No. 5,649,625 to Ovadia, the entire disclosure of which is incorporated herein, and preferably, each ring post 62 is formed in a mold in a manner described in more detail in U.S. Pat. No. 5,758,765 to Ovadia, the entire disclosure of which is also incorporated herein.

Each ring post 62 is formed in a part cylindrical or arcuate configuration secured at its bottom, back edge 63 to bottom wall 36 and extending upwardly at an acute angle of, for example, 500, from bottom wall 36. This configuration permits a ring to be placed on each ring post 62. In such box, because of the flexible and resilient material of ring post 62, the wall of ring post 62 can be compressed, and when a ring is positioned thereon, the wall of ring post 62 will expand back outwardly so that the ring is securely held thereon.

As shown, the upper end 66 of each ring post 62 is open. Preferably, although not essential, the side edges of each ring post 62 are cut-away to provide opposite arcuate edges 64, the lower edge of which is coincident with the bottom, back edge 63 of ring post 62.

It will be appreciated, however, that any other type of jewelry or other item can be displayed and stored in storage box 10. For example, a ring holding arrangement of the type disclosed in U.S. Pat. No. 5,511,653 to Ovadia in which pads are provided for holding jewelry items, can be provided in storage box 10. As another example, a conventional ring holding arrangement provided with slots for receiving the rings can be provided in bottom wall 36.

In other words, there are numerous uses for storage box 10 of the present invention. However, when dealing with jewelry items, when upper half 12 is removed, lower half 14 serves also as an aesthetic display for the jewelry items.

In order to carry or store the jewelry items, it is merely necessary to reinsert upper half 12 with the aforementioned interlocking, friction fit.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A storage box comprising:

an upper portion including:

a top wall, an upper side wall extending down from the top wall and having a lower facing edge, and the lower facing edge of said upper side wall being formed by inner and outer adjacent lower facing wall portions, the inner lower facing wall portion including recessed portions and projecting portions, and the outer lower facing wall portion including recessed portions and projecting portions, with the recessed portions of the inner lower facing wall portion being in alignment with the projecting portions of the outer lower facing wall portion, and the projecting portions of the inner lower facing wall portion being in alignment with the recessed portions of the outer lower facing wall portion;

a lower portion including:

a bottom wall, a lower side wall extending up from the bottom wall and having an upper facing edge, the upper facing edge of said lower side wall being formed by inner and outer adjacent upper facing wall portions, the inner upper facing wall portion including recessed portions and projecting portions and the outer upper facing wall portion including recessed portions and projecting portions, with the recessed portions of the inner upper facing wall portion being in alignment with the projecting portions of the outer upper facing wall portion, and the projecting portions of the inner upper facing wall portion being in alignment with the recessed portions of the outer upper facing wall portion, and the lower side wall having outer dimensions which are the same as outer dimensions of said upper side wall so as to form a continuation thereof, such that when the upper portion is assembled with the lower portion with the upper and lower side walls in mating relation, the recessed portions of said inner upper facing wall portion receive the projecting portions of said inner lower facing wall portion such that the projecting portions of said inner lower facing wall portion are in interlocking, friction engagement with the projecting portions of said outer upper facing wall portion, and the recessed portions of said outer upper facing wall portion receive the projecting portions of said outer lower facing wall portion such that the projecting portions of said outer lower facing wall portion are in interlocking, friction engagement with the projecting portions of said inner upper facing wall portion.

2. A storage box according to claim 1, wherein said recessed portions and projecting portions of each of said inner and outer adjacent upper facing wall portions and said inner and outer adjacent lower facing wall portions, are formed in an alternating manner.

3. A storage box according to claim 2, wherein said alternating recessed portions and projecting portions of each of said inner and outer upper facing wall portions form a substantially sinusoidal shape, and said alternating recessed portions and projecting portions of each of said inner and outer lower facing wall portions form a substantially sinusoidal shape of a complementary configuration to said substantially sinusoidal shaped alternating projecting portions and recessed portions of each of said inner and outer upper facing wall portions.

4. A storage box according to claim 1, wherein said upper and lower portions are made from a relatively rigid plastic material that has sufficient flexibility and resilience to permit said interlocking, friction fit.

5. A storage box according to claim 1, wherein each of said upper and lower portions has a substantially rectangular configuration.

6. A storage box according to claim 1, wherein said lower box further includes at least one jewelry holder therein for holding a jewelry item.

7. A storage box according to claim 6, wherein said at least one jewelry holder includes an arrangement of ring posts extending upwardly from an inner surface of said bottom wall.

8. A storage box according to claim 7, wherein each said ring post is formed as a thin walled, resilient structure in a part cylindrical configuration that extends upwardly from said bottom wall at an acute angle, and has opposite free edges.

9. A storage box according to claim 8, wherein each said ring post has an open, upper end.

* * * * *